United States Patent [19]

Haubold et al.

[11] Patent Number: 4,612,147

[45] Date of Patent: Sep. 16, 1986

[54] PROCESS FOR THE MANUFACTURE OF HYDROPHILIC POLYESTER FIBERS

[75] Inventors: Herbert Haubold, Wörth; Bernhard Burg, Wuppertal, both of Fed. Rep. of Germany

[73] Assignee: Akzona Incorporated, Asheville, N.C.

[21] Appl. No.: 579,651

[22] Filed: Feb. 14, 1984

[30] Foreign Application Priority Data

Feb. 19, 1983 [DE] Fed. Rep. of Germany ..... 3305798

[51] Int. Cl.[4] ..... D01F 1/02; D01F 1/07

[52] U.S. Cl. ..... 264/46.1; 264/49; 264/171; 264/210.6; 264/210.8; 264/211; 264/232; 264/234; 264/344; 264/345

[58] Field of Search ..... 264/41, 45.9, 46.1, 264/49, 171, 211, 210.6, 210.8, 232, 234, 344, 345

[56] References Cited

U.S. PATENT DOCUMENTS 4,307,152 12/1981 Mathes et al. ..... 264/171
4,361,617 11/1982 Suzuki et al. ..... 264/49
4,371,485 2/1983 Mathes et al. ..... 264/211
4,413,074 11/1983 Wrasidlo et al. ..... 264/48

*Primary Examiner*—Donald Czaja
*Assistant Examiner*—Hubert C. Lorin
*Attorney, Agent, or Firm*—Jeffrey S. Boone

[57] ABSTRACT

Polyester fibers containing one or more oxalate complexes of the general formula $$Me_n[Z(C_2O_4)_m]$$

are drawn and subjected to a hydrosetting process at temperatures of 90° to 170° C. in the presence of liquid water, the water containing one or more of the following surfactants: salts of partial esters of phosphoric aid, sulfosuccinic aid esters, phosphonic acid esters as well as ethoxylated silicon compounds, ethoxylated fatty alcohols, polyglycol esters of fatty acids as well as various imidazole salts of partially or completely hydrogenated imidazoles. In this way the hydrosetting process is accelerated and a more stable pore structure is obtained. Water absorption and retention are also increased.

7 Claims, No Drawings

PROCESS FOR THE MANUFACTURE OF HYDROPHILIC POLYESTER FIBERS

BACKGROUND OF THE INVENTION

The invention relates to a process for the manufacture of polyester fibers by spinning a polyester mass containing an oxalato complex and drawing of the resulting yarn, followed, as the case may be, by hydrosetting of the same in the presence of liquid water.

A previously developed process is described in U.S. Pat. Nos. 4,307,152 and 4,371,485. The process for the manufacture of hydrophilic polyester fibers described in the above referenced U.S. patents is characterized by the spinning of a polyester mass containing 1 to 20% by weight of one or several oxalato complexes of the general formula $$Me_n[Z(C_2O_4)_m],$$

drawing of the resulting yarn and hydrosetting in the presence of liquid water at temperatures within a range from 90 to 170° C., the meaning of the symbols in the formula being:

Me=at least one of the ions Li, Na, K, Rb, Cs or NH;

Z=at least one complex-forming central atom from the group Mg, Ca, Sr, Ba, Zr, Hf, Ce, V, Cr, Mn, Fe, Co, Ni, Cu, Zn, Cd, B, Al, Ga, In, Sn, Pb, and Sb;

n=~1, ~2, ~3 or ~4, and m=~2, ~3 or ~4.

By means of this process, one obtains polyester fibers having outstanding hydrophilic characteristics and excelling through a high moisture uptake and a very favorable water retentivity. In addition, they are flame-resistant. The corresponding hydrophilic characteristics will not come about without hydrosetting. It is therefore one object of the invention to provide a process which makes possible the manufacture of hydrophilic polyester fibers with an increased moisture uptake, a higher water retentivity, and a lower density.

It is also an object of the invention to make possible the obtaining of hydrophilic polyester fibers within a shorter period of time than is the case with a prior process.

Another object of the invention is to provide a process for the manufacture of hydrophilic polyester fibers the hydrophilic characteristics of which are far-reachingly stable so that a fabric made from such fibers will retain its favorable wear characteristics for an extended period of time, even after repeated launderings.

SUMMARY OF THE INVENTION

In accordance with one form of the invention, hydrophilic polyester fibers are made by spinning a polyester mass containing 1 to 20% by weight of one or several oxalato complexes of the general formula $$Me_n[Z(C_2O_4)_m],$$

drawing of the resulting yarn, and hydrosetting in the presence of liquid water at temperatures of 90° to 170° C. Hydrosetting in water is carried out in the presence of certain surfactants, namely salts soluble or dispersible in water of partial esters of phosphoric acid, of sulfosuccinic or phosphonic esters, ethoxylated silicone compounds soluble or dispersible in water, as well as ethoxylated fatty alcohols, fatty acid polyglycol esters and various imidazole salts of partially or completely hydrated imidazoles. The presence of these surfactants has the effect that hydrosetting proceeds more rapidly and that a more stable pore structure is obtained. This becomes noticeable through an increased water uptake, as well as an increased water retentivity. Textiles made of fibers manufactured in this manner retain their hydrophilic characteristics for a long time, even after frequent wearing and laundering.

DESCRIPTION OF THE PREFERRED EMBODIMENTS

Specific means for attaining the objectives heretofore set forth are described below. A process is provided for the manufacture of hydrophilic polyester fibers by spinning a polyester mass containing 1 to 20% by weight of one or several oxalato complexes of the general formula $$Me_n[Z(C_2O_4)_m]$$

wherein

Me is at least one of the ions Li, Na, K, Rb, Cs or $NH_4$;

Z is at least one complex-forming central atom from the group Mg, Ca, Sr, Ba, Zr, Hf, Ce, V, Cr, Mn, Fe, Co, Ni, Cu, Zn, Cd, B, Al, Ga, In, Sn, Pb and Sb;

n is ~1, ~2, ~3, or ~4 and m is ~2, ~3, or ~4, drawing of the resulting yarn and hydrosetting in the presence of liquid water at temperatures from 90° to 170° C., characterized by the fact that hydrosetting in water is carried out in the presence of at least one of the following surfactants:

1. Salts of partial esters of phosphoric acid, soluble or dispersible in water, of the general formulae

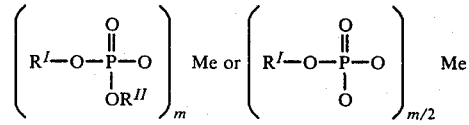

wherein $R^I$ and $R^{II}$ may be the same, or different, and in each case stand for an alkyl radical with 2 to 20 C atoms, Me signifies a mono- or multivalent cation of a metal, or a monovalent cation of the general formula

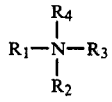

whereby the radicals $R_1$ to $R_4$ may be the same, or different, and in each case signify hydrogen, an alkyl radical with 1 to 20 C atoms, or a radical of the formula (CH CH —O)$_r$R, in which r may have values from 1 to 20 and $R_5$ is a hydrogen atom or an aklyl radical, while m is the valence of the metal cation Me.

2. Salts, soluble or dispersible in water, of partial esters of phosphoric acid, of the general formula;

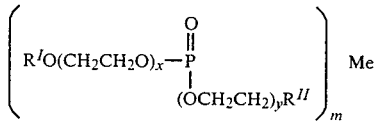

or

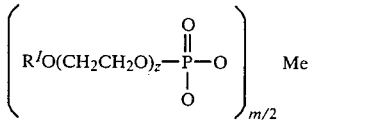

whereby $R^{I}$, $R^{II}$ and Me have the meaning defined under 1., and x and y may be the same, or different, and may have values from 0 to 20, but x+y are at least equal to 1, and z has a value from 1 to 20.

3. Alkali salts, soluble or dispersible in water, of sulfosuccinic acid of the general formula

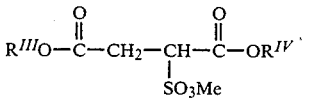

whereby $R^{III}$ and $R^{IV}$ are the same, or different, and in each case signify an aklyl radical of 6 to 20 C atoms, and Me is an alkali metal.

4. Alkali salts, soluble or dispersible in water, of phosphonic esters of the general formula

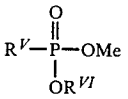

whereby $R^{V}$ is an alkyl radical with 2 to 12 C atoms and $R^{VI}$ an alkyl radical with 1 to 12 carbon atoms and $R^{V}$ and $R^{VI}$ may be the same, or different, while Me is an alkali metal.

5. Silicone compounds, soluble or dispersible in water, of the general formula

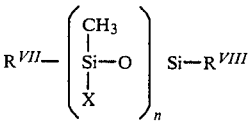

whereby $R^{VII}$ and $R^{VIII}$ may be the same, or different, and in each case signify an alkyl radical with 1 to 10 carbon atoms, or a radical of the general formula $(CH_2CH_2O)_m$—R, whereby m=1 to 5 and $R_6$ is hydrogen or an alkyl radical, while 10 to 90% of all X are a methyl group and 90 to 10% are a radical of the general formula $(CH_2CH_2O)_tH$, wherein t may have values from 1 to 20, and may be the same, or different, for all radicals X, and has n values, so that the molecular weight of the silicone compound is between 300 and 10,000.

6. Ethoxylated fatty alcohols, soluble or dispersible in water of the formula $R—O(CH_2CH_2O)_xH$, wherein R signifies an alkyl radical with 8 to 22 carbon atoms, and x may have a value from 1 to 20.

7. Imidazole salts, or salts of partly or completely hydrogenated imidazoles, soluble or dispersible in water, of the general formula

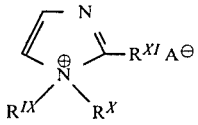

wherein $R^{IX}$ and $R^{XI}$ may be the same, or different, and signify an alkyl group with 1 to 20 C atoms, and $R^{X}$ signifies an alkyl group with 1 to 10 carbon atoms, or a radical of the general formula $(CH_2CH_2O)_sH$, in which s may have values from 1 to 20, while A⊖ is the anion of a monovalent inorganic or organic acid, or the monovalent anion of a multivalent, partly esterified inorganic or organic acid no longer exhibiting any acid functions.

8. Fatty acid polyglycol esters of the general formula

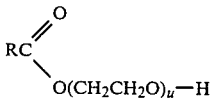

wherein R signifies an alkyl radical with 8 to 22 carbon atoms, and u may have a value from 1 to 20.

Preferably, alkali etals are used as salts, with potassium salts being especially favorable. The surfactant is preferably used in quantities of 0.05 to 5%, in particular in quantities from 0.1 to 1.5%, in the aqueous bath.

In an especially advantageous version of the process pursuant to the invention, hydrosetting is carried out within a temperature range from 120° to 150° C.

To carry out the process pursuant to the invention, one prepares first a polyester mass containing 1 to 20% by weight of the mentioned oxalato complex as described in U.S. Pat. Nos. 4,307,152 and 4,371,485, the disclosures of which are hereby incorporated into this application by reference. The mass is spun into fibers, and the resulting fibers are drawn. Melt-spinning and drawing can be carried out under conditions customarily employed in the preparation of polyesters, making use of conventional equipment.

Hydrosetting is carried out at temperatures within a range from 90° to 170° C., whereby one, or several of the surfactants have been added to the water used for setting. In general, the surfactants used are at least extensively soluble or dispersible in water. Even added in very small quantities, the surfactant will exhibit a favorable effect. Thus, in many cases, already 0.1, or even 0.05% of the agent, in the aqueous bath, are sufficient to obtain better hydrophilic fibers. Preferably, use is made of 0.1 to 1.5% of the surfactant. It is also possible, to use higher concentrations, e.g. 5 or 10%. However, in the case of higher concentrations, one can in some cases expect a decline of the advantageous effect.

The fibers to be treated can be placed in a hydrosetting bath, which is still at room temperature and is then heated to a temperature between 90° and 170° C. In general, a treatment of a few minutes duration in the indicated range is sufficient to impart the desired hydrophilic characteristics to the fiber.

By hydrosetting within the concept of the invention is meant a treatment of the polyester fiber containing one or several of the mentioned oxalato complexes with liquid water at a temperature within the range from 90° to 170° C. at any point in time after drawing. It is appropriate to apply the treatment in the indicated temperature range for at least about 3 minutes.

It is expedient to apply such a treatment continuously if it is carried out during the fiber manufacturing process after drawing and crimping, or discontinuously when fibers, yarns or finished grey cloth is to be hydroset. For both types of hydrosetting, use can be made of equipment as is being offered by various equipment suppliers for hydro-thermal setting processes.

It is important for the success of hydrosetting, in particular for the stability of the pore system formed thereby, that the material to be hydroset should not have been exposed to any preceding hot air treatment above 120° C., or to a steam treatment.

Above all, the duration of hydrosetting required to conclude setting and to obtain a stable system, depends also upon the temperature at which hydrosetting is carried out. Thus, when higher temperatures are used, it is possible to make do with shorter durations, than would be the case when the work is done at lower temperatures.

It is especially advantageous if hydrosetting pursuant to the invention is performed during high temperature, dyeing or white tinting be carried out under the indicated conditions. As already mentioned, hot air treatments above 120° C. should be avoided before such a treatment. Washing below 90° C. should also be avoided before hydrosetting, since otherwise the results obtained in regard to moisture uptake and water retentivity are considerably worse.

In a continuous hydrosetting process pursuant to the invention, the active substances can be applied to the material to be treated in a wetting bath; thereby, the material should be wetted with a quantity of water amounting to at least 100% of the weight of the material.

The active substances can already be applied during earlier processing stages, e.g. before drawing of the fibers. It is important that hydrosetting be carried out in the presence of liquid water.

It goes without saying that, in the continuous hydrosetting processes, care must be taken that sufficient liquid water is present on the fiber during hydrosetting. Thus, in the case of temperatures up to just below 100° C., and under normal pressure, it is enough when the fiber material has first been soaked in water containing the addition of surfactant pursuant to the invention, so that the quantity of water taken up is at least 100, and preferably 200 to 300 or more percent. If hydrosetting is carried out at higher temperatures, care must be taken that the pressure is increased with such a mode of operation, so that the water will continue to surround the fibers in liquid form.

After hydrosetting, the treated fiber can be dried immediately and subjected to further aftertreatment operations.

It was especially surprising that, as a result of the process pursuant to the invention, it has been possible to increase the moisture uptake of the fibers distinctly, compared with fibers where hydrosetting had been carried out with pure water, or water not containing the additives pursuant to the invention. In addition, the process pursuant to the invention increases the water retentivity.

Compared to the hydrosetting treatment with pure water, the pore system, which is responsible for the hydrophilic properties of the polyester, is formed more rapidly and is also more stable.

Furthermore, there is less depositing of oligomers on the fiber surface during hydrosetting.

It is possible to combine the treatment pursuant to the invention with a high-temperature dyeing process. In such cases it is necessary that, in addition to conventional additives, the mentioned surfactants be added to the dye bath in appropriate concentrations.

The hydrophilic fibers manufactured in the manner pursuant to the invention can be processed into yarns, textiles, and the like, in the customary manner.

Such textiles exhibit excellent use characteristics. Compared with textiles made of normal polyester types, they are extraordinarily hydrophilic whereby the high moisture uptake, the high moisture perception limit and the high water retentivity must be especially emphasized.

The invention is explained in greater detail by way of the following example:

EXAMPLE

A. Preparation and Grinding of the Oxalato Complex $K_3[Al(C_2O_4)_3]$ was prepared in the manner described by J. C. Bailar and E. M. Jones in Inorganic Syntheses 1 (1939), p. 36. Subsequently, the resulting complex salt was dried for 15 hrs. at 150° C. and about 10 Torr. The analyses of samples obtained in different batches were between $K_{2.87}[Al(C_2O_4)_{3.02}]$ and $K_{3.36}[Al(C_2O_4)_{3.46}]$. 200 g of the dried complex salt, together with 400 g of ethylene glycol, were ground for about 2 hrs. in a pearl mill (model PM1 of the firm Draiswerke, Mannheim), using 410 g of quartz beads of a diameter of 1 to 3 mm. After grinding, the diameter of the biggest complex salt particle in the dispersion was about 4μ while the bulk of the particles had a size of 1μ. After that, the quartz beads were removed by means of filtration through a screen, rinsed with 200 ml of ethylene glycol, and the dispersion diluted with the rinsing solution. By letting the dispersion stand for 72 hrs in tall storage vessels, the particles having a size of more than 2μ were far-reachingly removed (sedimentation).

B. Polycondensation

Together with the transesterification product of 1350 g dimethyl terephthalate and 120 g ethylene glycol, 600 g, or 300 g, of this dilute dispersion with a $K_3[Al(C_2O_4)_3]$ content of 150 g, or 75 g, were transferred to the polycondensation vessel at a stirring speed of 30 rpm and a temperature of about 246° C. The transesterification catalyst was 150 ppm of zinc acetate and the condensation catalyst 200 ppm antimony trioxide. It was possible to use ethylene glycol that had been distilled off for other condensations without having to be purified. The polycondensate contained 10 (Example 1) or 5 (Example 2) percent by weight of $K_3[Al(C_2O_4)_3]$.

C. Manufacture of the Fibers

The resulting polycondensate was, as customary, cut into chips and dried for 24 hours at 125° C. and 60 torr. Subsequently, the chips were made into fibers in the customary manner, by means of melt-spinning, drawn, and cut to a staple length of 40 mm.

D. Hydrosetting

For hydrosetting, use was made of Linitest apparatus (manufacturer Original Hanau Quarzlampen GmbH), which contained a beaker with a 280 ml capacity, and devices for stirring and heating. The hydrosetting bath was made up of 198 ml of water and 2 g of one of the surfactants listed in examples 1–8, in the following table.

The beaker containing the hydrosetting bath and the fiber material was placed in the bath heated to 140° C. After the hydrosetting bath had been heated to 140° C., hydrosetting was performed for 7 minutes, at this temperature, with stirring. Subsequently, the beaker was emptied and the treated fibers rinsed 3 times with distilled water, whereupon they were dried for 30 min. at 60° C. in a drying chamber with recirculated air. The characteristics of the fibers obtained in this manner are compiled in the following table. The stability test consisted of setting the hydroset fibers for 1 minute at 190° C. in hot air, whereupon they were subjected to blank dyeing for 1 hr. at 120° C.

TABLE

| | | Moisture uptake | | Density | |
|---|---|---|---|---|---|
| | | Before | After | | |
| Example | Product | Stability test | | Before | After |
| 1 | Silastol 1455 | 9.6 | 8.5 | 1.083 | 1.118 |
| 2 | Silastol 1437 | 10.1 | 9.7 | 1.060 | 1.071 |
| 3 | Polyfix EC 100 | 9.1 | 8.6 | 1.056 | 1.104 |
| 4 | L 7602 | 9.7 | 8.7 | 1.096 | 1.102 |
| 5 | Leomin RWS | 10.1 | 8.1 | 1.106 | 1.123 |
| 6 | Elfan NS 243 S | 9.3 | 7.6 | 1.046 | 1.129 |
| 7 | Genapol X020 | 9.2 | 8.0 | 1.230 | 1.201 |
| 8 | Ardue M423 | 10.5 | 8.4 | 1.086 | 1.143 |
| 9 | Water | 8.2 | 6.8 | 1.137 | 1.114 |

It can be seen that, compared to a hydrosetting treatment with pure water alone, the fibers treated pursuant to the invention exhibit a higher moisture uptake. Even after the stability test, the moisture uptake is still very high and exceeds the moisture uptake of fibers hydroset only with water without the additive pursuant to the invention.

The surfactants used in Examples 1 to 8 involve commercial products which are available under the listed names from the firms named below:

Silastol and Polyfix from the firm Schill & Seilacher, Boeblingen, West Germany; L 7602 from the firm Union Carbide Co., U.S.A.; Leomin RWS and Genapol from the firm Hoechst A.G., Frankfurt/Main-Hoechst, West Germany; and Elfan and Ardue M 243 from the firm Akzo Chemie G.m.b.H., Dueren/Rhineland, West Germany.

We claim:

1. A process for the manufacture of hydrophilic polyester fibers comprising the steps of (1) spinning of a polyester mass containing 1 to 20% by weight of one or several oxalato complexes of the general formula $$Me_n[Z(C_2O_4)_m]$$

wherein

Me is an ion selected from the group consisting of Li, Na, K, Rb, Cs or $NH_4$;

Z is a complex-forming central atom selected from the group consisting of Mg, Ca, Sr, Ba, Zr, Hf, Ce, V, Cr, Mn, Fe, Co, Ni, Cu, Zn, B, Al, Ga, In, Sn, Pb and Sb;

n is ~1, ~2 ~3, or ~4; and m is ~2, ~3 or ~4;

(2) drawing of the resulting yarn; and (3) hydrosetting the yarn in the presence of liquid water at temperatures of 90° to 170° C., whereby the fact that hydrosetting is carried out in the presence of at least one surfactant, selected from the group consisting of (a) Salts, soluble in water or dispersible in water, of partial esters of phosphoric acid, of the general formulas

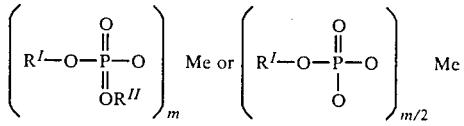

wherein $R^I$ and $R^{II}$ may be the same, or different and, in each case stand for an alkyl radical with 2 to 20 C atoms, Me signifies a mono- or multivalent cation of a metal, or a monovalent cation of the general formula

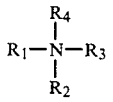

whereby the radicals $R_1$ to $R_4$ may be the same, or different, and in each case signify hydrogen, an alkyl radical with 1 to 20 C atoms, or a radical of the formula $(CH_2CH_2—O)_rR_5$, in which r may have values from 1 to 20 and $R_5$ is a hydrogen atom or an alkyl radical, while m is the valence of the metal cation Me;

(b) Salts, soluble or dispersible in water, of partial esters of phosphoric acid, of the general formula

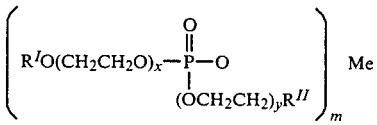

or

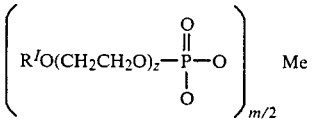

whereby $R^I$, $R^{II}$ and Me have the meaning defined above, and x and y may be the same, or different, and may have values from 0 to 20, but x+y are at least equal to 1, and z has a value from 1 to 20;

(c) Alkali salts, soluble or dispersible in water, of sulfosuccinic acid, of the general formula

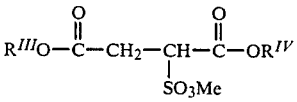

whereby $R^{III}$ and $R^{IV}$ are the same, or different, and in each case signify an alkyl radical of 6 to 20 C atoms, and Me is an alkali metal;

(d) Alkali salts, soluble or dispersible in water, of phosphonic esters of the general formula

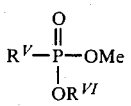

whereby $R^V$ is an alkyl radical with 2 to 12 C atoms and R an alkyl radical with 1 to 12 carbon atoms and $R^V$ and $R^{VI}$ may be the same, or different, while Me is an alkali metal;

(e) Silicone compounds, soluble or dispersible in water, of the general formula

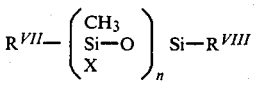

whereby $R^{VII}$ and $R^{VIII}$ may be the same, or different, and in each case signify an alkyl radical with 1 to 10 carbon atoms, or a radical of the general formula $(CH_2CH_2O)_m—R_6$, whereby m=1 to 5 and $R_6$ is hydrogen or an alkyl radical, while 10 to 90% of all X are a methyl group, and 90 to 10% a radical of the general formula $(CH_2CH_2O)_tH$, wherein t may assume values from 1 to 20, and may be the same, or different, for all radicals X and exhibits n values, so that the molecular weight of the silicone compound is between 300 and 10,000;

(f) Ethoxylated fatty alcohols, soluble or dispersible in water, of the formula $R—O(CH_2CH_2O)_xH$, wherein R signifies an alkyl radical with 8 to 22 carbon atoms, and x may have a value from 1 to 20;

(g) Imidazole salts, or salts of partly or completely hydrogenated imidazoles, soluble or dispersible in water, of the general formula

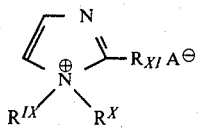

wherein $R^{IX}$ and $R^{XI}$ may be the same, or different, and signify an alkyl group with 1 to 20 C atoms, and $R^x$ signifies an alkyl group with 1 to 10 carbon atoms or a radical of the general formula $(CH_2CH_2O)_sH$, in which s may have values from 1 to 20 while $A\ominus$ is the anion of a monovalent, inorganic or organic acid, or the monovalent anion of a multivalent, partly esterified inorganic or organic acid no longer exhibiting any acid functions;

(h) Fatty acid polyglycol esters, soluble or dispersible in water, of the general formula

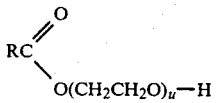

wherein R is an alkyl radical with 8 to 22 carbon atoms, and $\mu$ may exhibit a value from 1 to 20.

2. A process as put forth in claim 1, wherein said salts are alkali metal salts.

3. A process as put forth in claim 2, wherein said alkali metal salts are potassium salts.

4. A process as put forth in claims 1, 2 or 3, wherein the at least one surfactant is used in quantities from 0.05 to 5% of the aqueous bath.

5. A process as put forth in claim 4, wherein the at least one surfactant is used in quantities from 0.1 to 1.5%.

6. A process as put forth in claims 1, 2, 3 or 5, wherein the hydrosetting operation is executed in a temperature range from 120° to 150° C.

7. A process as put forth in claim 4, wherein the hydrosetting operation is executed in a temperature range from 120° to 150° C.

* * * * *